United States Patent [19]

Grogan

[11] 4,174,069

[45] Nov. 13, 1979

[54] ADJUSTABLE SPRAY FLUID DISPENSER

[75] Inventor: Richard P. Grogan, Ontario, Calif.

[73] Assignee: Diamond International Corporation, New York, N.Y.

[21] Appl. No.: 857,415

[22] Filed: Dec. 5, 1977

[51] Int. Cl.[2] ..... B05B 11/01

[52] U.S. Cl. ..... 239/333; 222/383; 239/590.5

[58] Field of Search ..... 239/333, 493, 590, 590.5, 239/601, 526, 456, 582; 222/207, 385, 214, 383

[56] References Cited

U.S. PATENT DOCUMENTS

| | | | |
|---|---|---|---|
| 3,758,007 | 9/1973 | Rosen | 239/590.5 |
| 3,995,774 | 12/1976 | Cooprider et al. | 222/383 |

*Primary Examiner*—James B. Marbert

*Attorney, Agent, or Firm*—Lawrence R. Radanovic

[57] ABSTRACT

A fluid dispenser has a discharge path outletting at a discharge orifice provided in a nozzle cap in engagement with a nipple surrounding a dispenser needle valve, the cap being adjustable axially of the needle valve so as to move an open ended swirl chamber, which surrounds the discharge orifice, relative to the needle valve into and out of engagement therewith. The fluid is emitted from the discharge orifice in a concentrated and linear pattern upon disengagement between the swirl chamber and the needle valve. Otherwise, upon movement of the cap until the needle valve plugs the open end of the swirl chamber, a shaped spray pattern is created through the discharge orifice. The orifice is defined by a circular wall and by a pair of opposed projections thereon, the projections extending inwardly of the orifice and having spaced apart ends so as to effect a substantially flat spray pattern through the orifice when movement of the cap toward the needle valve causes the valve to plug the swirl chamber end.

8 Claims, 6 Drawing Figures

ADJUSTABLE SPRAY FLUID DISPENSER

BACKGROUND OF THE INVENTION

This invention relates generally to a fluid dispenser having an adjustable spray capability, and more particularly to such dispenser wherein the spray pattern may be varied between a linear spray and a substantially flat spray.

The prior art discloses sprayers in which fluid may be selectively emitted either as a solid stream or as a spray pattern through the same discharge orifice upon relative adjustment of a swirl chamber. Such sprayers are exemplified by U.S. Pat. Nos. 2,416,719, 2,626,185 and 3,961,756. However, the spray pattern through the discharge orifice is typically conical in shape since the discharge orifice is defined by a circular wall opening through which the fluid is emitted.

In each of the aforementioned patents fluid is forced to flow through tangential slots provided in a swirl chamber so as to produce a vortex or fluid whirling action adjacent the discharge orifice. Another type of adjustable spray nozzle is disclosed in U.S. Pat. No. 2,989,250 wherein recesses defining projections therebetween are disposed near the discharge orifice, but not therewithin, so as to break-up the fluid into a fine mist spray when emitting through the discharge orifice.

The nozzle cap disclosed in U.S. Pat. No. 3,995,774, commonly owned herewith, has provided thereon a swirl chamber surrounding the discharge orifice in the cap. A needle valve on the nipple or nozzle of the pump extends outwardly adjacent the discharge outlet and, when the needle valve plugs the open end of the swirl chamber upon movement of the nozzle cap, the fluid is forced through tangential slots and enters the chamber in a rapidly whirling motion so as to emit through a circular discharge orifice as a conical spray. Otherwise, the cap may be adjusted so that the swirl chamber is moved away from the needle valve thereby creating a solid stream through the discharge orifice. Or, the cap can be fully tightened so that the needle valve extends through the swirl chamber for endwise sealing relation with the discharge orifice thereby fully closing off the orifice in a closed or shipping position.

SUMMARY OF THE INVENTION

It is an object of the present invention to improve upon the adjustable spray fluid dispensers by providing for a substantially flat spray thereby expanding upon the use to which the sprayer may be put by those desiring use of such a flat spray.

To this end the discharge orifice provided in the nozzle cap adjacent the swirl chamber on the cap is defined by an irregular opening wherein a pair of spaced apart projections extend inwardly of the circular wall of the discharge orifice. A solid stream of a flat spray may be selectively discharged through the same discharge orifice as the cap is adjusted so that the needle valve projects into the swirl chamber or is separated therefrom, respectively. Also, the nozzle cap may be tightened for extending the needle valve axially through the swirl chamber for endwise sealing relation with the discharge orifice.

Other objects, advantages and novel features of the invention will become more apparent from the following detailed description of the invention when taken in conjunction with the accompanying drawings.

DETAILED DESCRIPTION OF THE INVENTION

Figure 1:
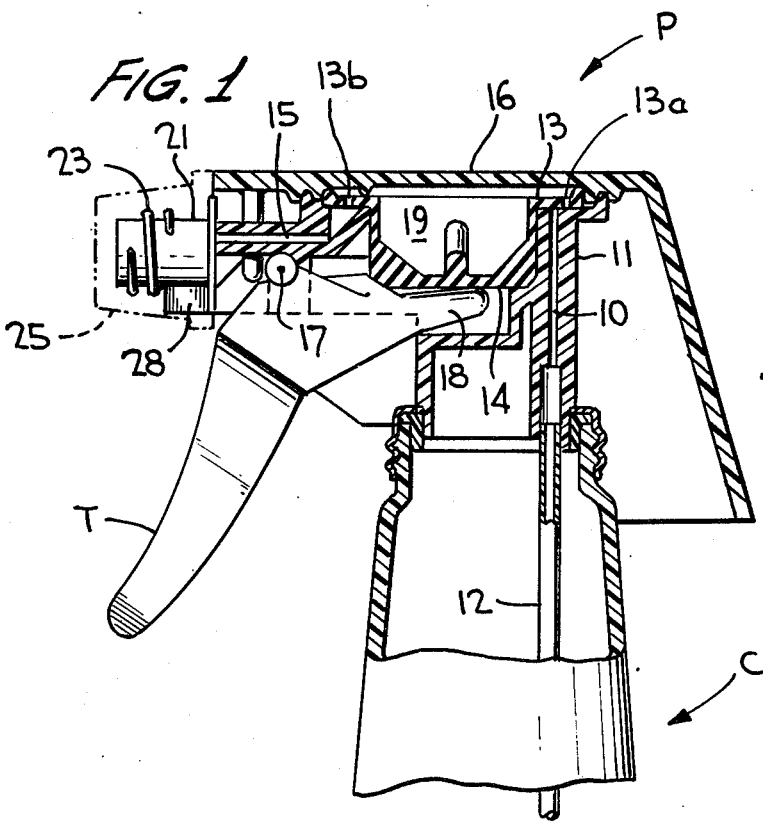
FIG. 1 is a side elevational view, partly in section, of a trigger actuated dispenser incorporating the present invention.

Turning now to the drawings wherein like reference characters refer to like and corresponding parts throughout the several views, a dispensing pump arrangement generally designated P is shown in FIG. 1 mounted in any normal manner on a fluid supply container C, the pump being generally similar to that disclosed in co-pending application Ser. No. 817,864 and commonly owned herewith. An inlet passage 10 is formed in a lower housing member 11 of the pump and communicates through a dip tube 12 with the fluid in the container. A resilient and deformable diaphragm 13 is seated on the lower housing member and is provided adjacent passage 10 with a hole **13*a* in a peripheral flange of the diaphragm surrounding a dome portion 14 thereof. Another aperture 13*b* is provided in the diaphragm flange adjacent an outlet passage 15 provided in the lower housing. An upper housing 16 is secured to the lower housing in a fluid tight manner, and a lever or trigger element T is mounted on the lower housing for pivotal movement about an axis 17. Upon actuation of the trigger causing its free end 18 to bear against dome 14 of the diaphragm for deforming same upon actuation as by pulling on the trigger in a counter-clockwise direction, as seen in FIG. 1, the volume of pump chamber 19, jointly defined by the diaphragm and the upper housing is reduced. Upon such deformation, the fluid to be dispensed from within the pump chamber, after the pump has been primed, is discharged through aperture 13*b* and into outlet passage 15** similarly as that described in the aforementioned U.S. Pat. No. 3,995,774. The entirety of the disclosure of this patent is therefore specifically incorporated herein by reference.

Figure 2:
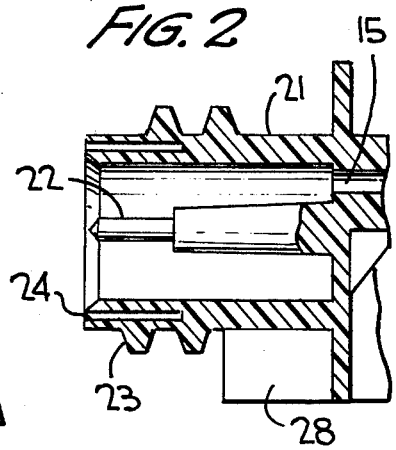
FIG. 2 is an enlarged sectional view in side elevation of the pump nozzle or nipple.

The fluid discharged from passage 15 enters a nozzle or nipple 21 mounted at the forward end of the lower housing and surrounding a needle valve 22 likewise mounted at such forward end and disposed adjacent passage 15 as seen in FIG. 2. The nipple is threaded along its outer periphery as at 23 and is split adjacent its outer end as at 24.

A nozzle cap 25 is internally threaded as at 26 (FIGS. 3 and 4) for cooperation with external threads 23 of the nipple. The cap has a stop element 27 adjacent its threads for bearing against a stop flange 28 located on the nipple for limiting the number of turns which the cap can make when being unthreaded on the nipple. The cap has a closed end wall 29 with a sleeve 31 extending inwardly thereof. This sleeve is slightly bulged at its free end as at 32 and is relatively flexible compared to that of the more rigid remainder of the cap. Bulged end 32 bears against the inner wall of the nipple (FIG. 6) when the cap is threaded onto the nipple. The split wall 24 of the nipple renders this otherwise rigid element slightly flexible so as to effect a tight seal between sleeve 32 and the nipple when the cap is threaded in place.

A pair of arcuate flanges 33 and 34 are likewise mounted on the inner surface of end wall 29 and extend a short distance toward the needle valve so as to define a swirl chamber therebetween. Tangential slots 35 and 36 (FIG. 3) are formed between these flanges so that, when fluid is forced into the swirl chamber through these slots, it is caused to rapidly whirl adjacent a discharge orifice 37 provided in wall 29 of the nozzle cap.

Figure 6:
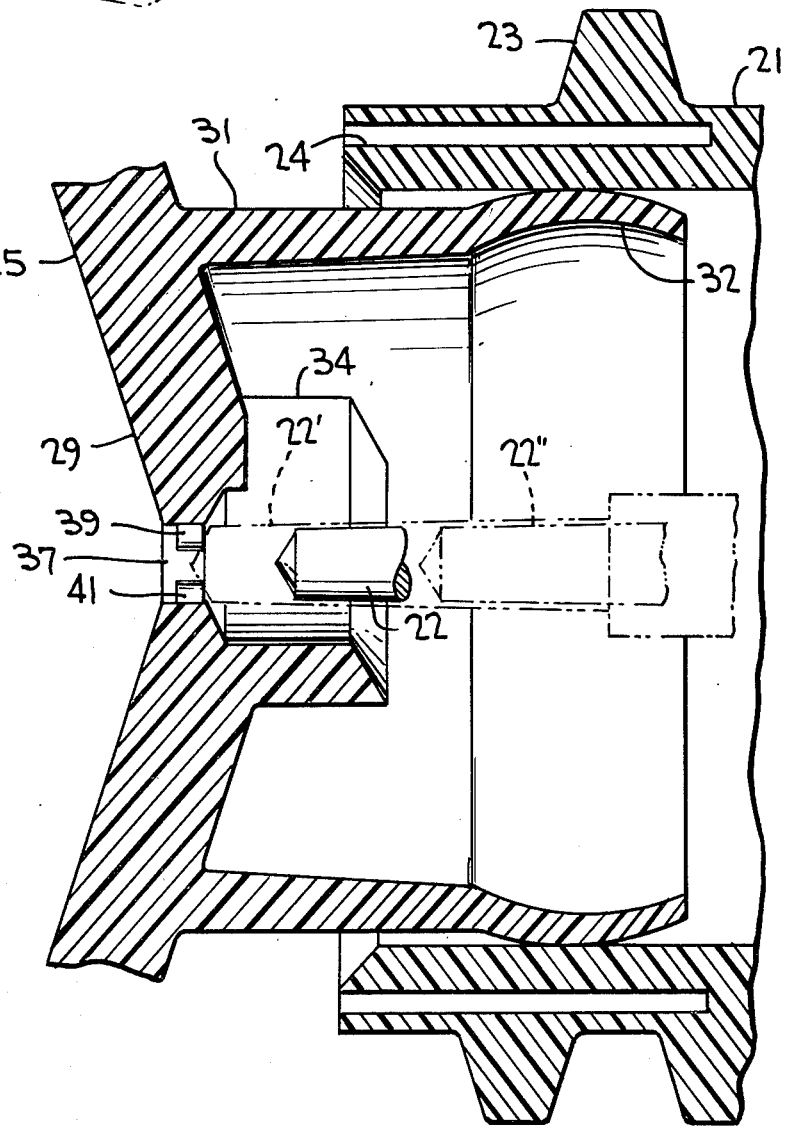
FIG. 6 is an enlarged sectional view in side elevation of the cap and its swirl chamber relative to the needle valve of the pump nozzle when the cap is adjusted axially of the nozzle.

Needle valve 22 is of a sufficient extent to be placed into endwise sealing engagement with the discharge orifice, as shown in phantom outline at 22' in FIG. 6, when the nozzle cap is fully threaded on the nipple. Hence, the dispenser is placed in a closed or storage position. Preparatory to dispensing fluid through the discharge orifice, the cap may be unthreaded to a position wherein the needle valve lies at a relative position as at 22", shown in phantom outline in FIG. 6, spaced a slight distance from flanges 33 and 34 defining the swirl chamber. Hence, upon actuation of the trigger the fluid is dispensed through the discharge passage of the pump and passes through the open end of flanges 33 and 34 so as to be discharged through the discharge orifice in a concentrated and solid stream. However, when the nozzle cap is adjusted into an intermediate position in which a needle valve is retracted from sealing relation with the orifice, but still is projected into the swirl chamber sufficiently to plug the inner axial end of that chamber (the needle being relatively so shown in solid outline in FIG. 6), fluid is permitted to enter the swirl chamber only through the tangential swirl slots 35 and 36. Actuation of the pump trigger then produces a spray pattern of the fluid through the discharge orifice.

Figure 3:
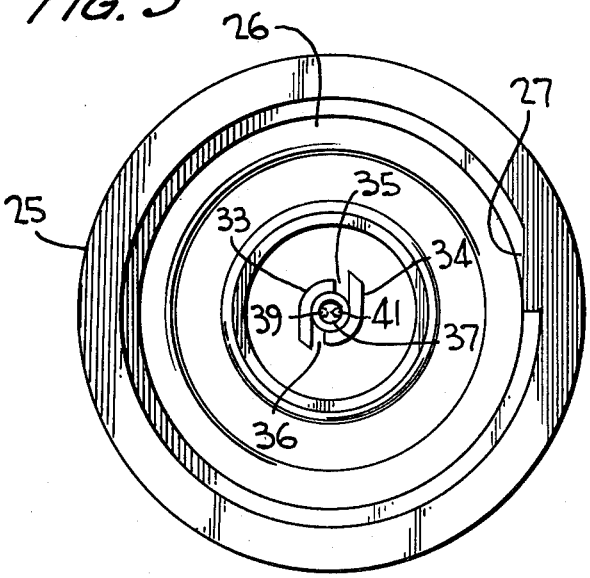
FIG. 3 is a plan view of the interior of the nozzle cap of the invention.
Figure 4:
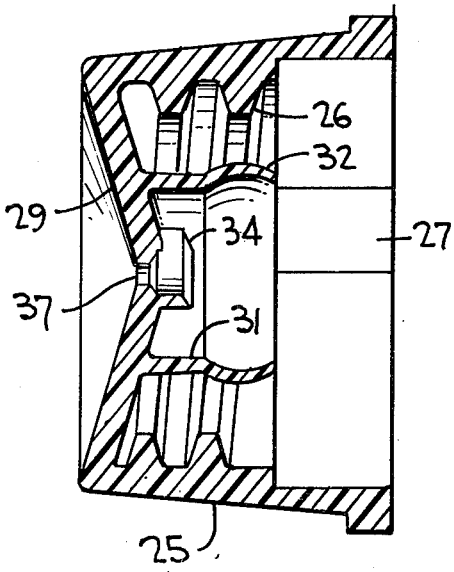
FIG. 4 is a transverse sectional view of the nozzle cap of FIG. 3.
Figure 5:
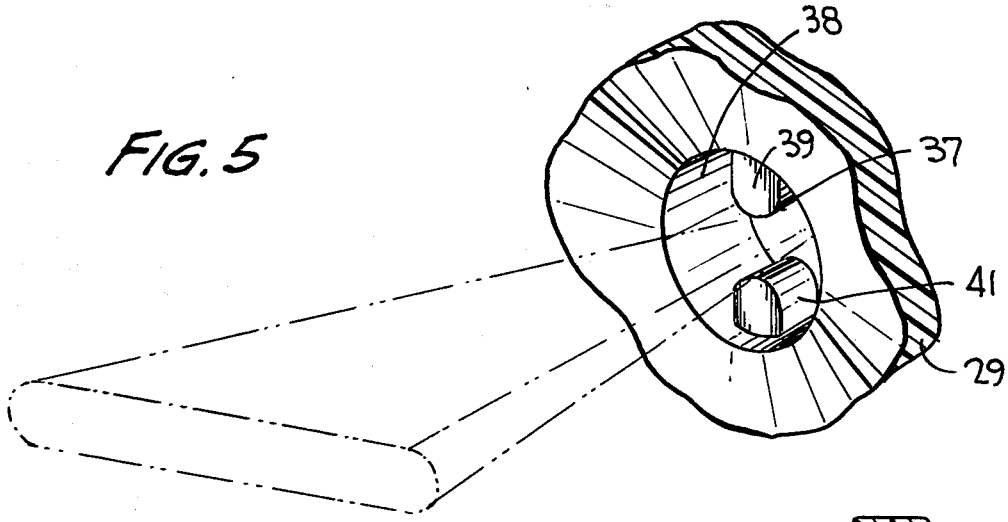
FIG. 5 is a perspective view of the discharge orifice provided in the cap of the invention and showing in phantom outline a flat spray pattern of the fluid emitting therethrough.

In accordance with the present invention, the discharge orifice is so designed as to effect other than a conical spray pattern of the prior art. As seen in FIGS. 3 and 5, the discharge orifice is partially defined by a circular wall opening 38, and is further defined by a pair of opposing projections 39 and 41 provided on wall 38 and extending inwardly of the orifice toward one another. The free ends of these projections are rounded and are slightly spaced apart, and the projections have a thickness in an axial direction less than the thickness of circular wall 38. Likewise, the inner sides of the projections lie substantially in the same plane as the inner edge of wall 38. Hence, upon adjusting the nozzle cap to its intermediate position wherein the needle valve plugs the inner axial end of the swirl chamber by projecting slightly thereinto, as shown in such relative position in solid outline in FIG. 6, actuation of the pump trigger produces a vortex or fluid whirling action within the swirl chamber as before. However, the coaction between the diametrically opposed projections 39 and 41 with the swirling fluid causes it to break-up into substantially flat spray segments which merge forwardly of the projections in a common flat plane for discharge as a substantially flat fan-like spray pattern as illustrated in phantom outline in FIG. 5. The projections serve to interrupt an otherwise conical spray through the orifice so as to flatten the spray pattern as it emits through the spray between the ends of the projections. And, as described above, the dispenser may be closed in a sealed position by simply threading the nozzle cap fully onto the nipple so as to cause the needle valve to extend through the swirl chamber into endwise sealing relation with the discharge orifice. For discharging a solid fluid stream, the nozzle cap is unthreaded until stop 27 bears against stop flange 28 whereupon the needle valve is in a position relative to the swirl chamber as shown at 22' in phantom outline in FIG. 6 whereupon the fluid is permitted to enter the inner axial end of the swirl chamber so as to proceed without being subjected to a swirl through the discharge orifice in a concentrated stream.

From the foregoing it can be seen that the flat fan-like spray mist made possible by the present invention is available for spraying in confined areas or in controlled geometric patterns when desired.

Obviously, many modifications and variations of the present invention are made possible in light of the above teachings. It is therefore to be understood that within the scope of the appended claims the invention may be practiced otherwise than as specifically described.

I claim:

1. In a dispensing pump having a pump housing containing inlet and outlet passages defining a discharge path for fluid from a supply container to a circular discharge orifice, a needle valve adjacent said outlet passage, a nipple surrounding said valve, a nozzle cap in engagement with said nipple for movement toward and away from said valve, said cap containing said orifice and having means defining an open ended swirl chamber thereon extending toward said valve and surrounding said orifice for effecting a discharge through said orifice of a fine fluid spray when movement of said cap toward said valve causes said valve to plug the open end of said swirl chamber means, the improvement comprising, said discharge orifice being defined by a circular wall opening and by a pair of opposed projections on said wall, said projections extending inwardly of said orifice toward one another and having free ends spaced a predetermined distance apart, whereby a fluid discharge of a substantially flat spray pattern is effected through said orifice between said spaced apart ends when the movement of said cap toward said valve causes said valve to plug the open end of said swirl chamber means.

2. The dispensing pump according to claim 1, wherein said free ends of said projections are rounded.

3. The dispensing pump according to claim 1, wherein said wall is of a predetermined thickness and said projections are of a thickness less than said predetermined thickness.

4. The dispensing pump according to claim 3, wherein said projections extend from an inner edge of said wall toward an outer edge thereof.

5. In a mechanism effecting a variable spray of fluid through a discharge orifice in a dispenser having a fluid outlet defining together with a fluid inlet a discharge path for fluid from a supply container, a needle valve extending outwardly of said discharge outlet and cooperating with an open ended swirl chamber means which surrounds said orifice and is located on an adjustable nozzle cap for varying the pattern of fluid spray through said orifice when said valve extends into said swirl chamber means, the improvement comprising, said orifice being defined by a wall opening in said cap having a pair of opposed projections on said wall, said projections extending inwardly of said orifice toward one another and having spaced apart free ends between which the fluid is dischargeable in a substantially flat spray pattern after being subjected to a vortex flow within said swirl chamber means when said nozzle extends into said swirl chamber means.

6. The mechanism according to claim 5, wherein said free ends of said projections are rounded.

7. The mechanism according to claim 5, wherein said wall is of a predetermined thickness and said projections are of a thickness less than said predetermined thickness.

8. The mechanism according to claim 5, wherein said projections extend from an inner edge of said wall toward an outer edge thereof.

* * * * *